US006364499B1

(12) United States Patent
Jones

(10) Patent No.: US 6,364,499 B1
(45) Date of Patent: Apr. 2, 2002

(54) APPARATUS FOR ILLUMINATING AN ARCHER'S ARROW

(75) Inventor: Thomas M. Jones, Wixom, MI (US)

(73) Assignee: Zephyr Archery Products, Co., Brighton, MI (US)

( * ) Notice: Subject to any disclaimer, the term of this patent is extended or adjusted under 35 U.S.C. 154(b) by 0 days.

(21) Appl. No.: 09/588,148

(22) Filed: Jun. 2, 2000

(51) Int. Cl.[7] ..... F21W 131/00; F21V 33/00; F21K 2/06

(52) U.S. Cl. ..... 362/109; 362/109; 362/802; 362/84; 124/91

(58) Field of Search ..... 362/84, 109, 253, 362/186, 802; 124/86, 91, 90

(56) References Cited

U.S. PATENT DOCUMENTS

| | | | | |
|---|---|---|---|---|
| 3,214,174 A | | 10/1965 | Saunders | |
| 4,106,079 A | | 8/1978 | Drury | 362/34 |
| 4,129,311 A | | 12/1978 | Hodgson et al. | 362/34 X |
| 4,340,930 A | | 7/1982 | Carissimi | 362/204 |
| 4,547,837 A | | 10/1985 | Bennett | 362/186 |
| 4,755,914 A | * | 7/1988 | Brett et al. | 362/109 |
| 4,856,792 A | | 8/1989 | Hardison | 273/416 |
| 4,900,038 A | | 2/1990 | Czetto et al. | 273/416 |
| 5,122,932 A | * | 6/1992 | Ziller | 362/109 X |
| 5,134,552 A | | 7/1992 | Call et al. | 362/203 |
| 5,339,227 A | * | 8/1994 | Jones | 362/109 |
| 5,649,525 A | * | 7/1997 | Koepf | 362/253 X |

* cited by examiner

*Primary Examiner*—Laura K. Tso
(74) *Attorney, Agent, or Firm*—Young & Basile, P.C.

(57) ABSTRACT

An apparatus for illuminating an archer's arrow that provides a nock adapted to receive a bowstring in a drawn position wherein a light source disposed withing the nock is activated when the bowstring is released from the drawn position. The nock provides a slot which is adapted to receive the bowstring. The slot provides a first widening portion adapted to receive the bowstring in a drawn position, and a second widening portion adapted to receive the bowstring when the bowstring is released from the drawn position. The nock also provides a bore which intersects at least a portion of the second widening portion of the slot. The light source is preferably a chemi-luminescent light stick which fits snugly within the bore of the nock. The bowstring engages and activates the light stick when the bowstring is released from the drawn position.

18 Claims, 3 Drawing Sheets

APPARATUS FOR ILLUMINATING AN ARCHER'S ARROW

FIELD OF THE INVENTION

The present invention relates to an archer's arrow, and in particular, to an archer's arrow having a chemical light source that is activated when the arrow is shot from an archer's bow to illuminate the archer's arrow.

BACKGROUND OF THE INVENTION

A long-existing problem for archers has been the difficulty of locating and retrieving an arrow after it has been shot from a bow. During hunting, when an arrow misses its mark, the arrow may land in dense bush, leaves, or the like, making it difficult to locate. When an arrow hits its target, such as an animal, the animal will often travel some distance before falling, sometimes in dense brush or woods. This also makes it difficult to locate the arrow and the animal. The problem of locating the arrow is further accentuated by the loss of light at dusk or after darkness.

Previous arrow designs have attempted to resolve the above-noted problems by providing an electrical light assembly within an arrow nock or within the shaft of the arrow. Such designs have utilized electrical circuits having a lamp, battery, and a switch for closing and opening the electrical circuit to energize and de-energize the lamp, respectively. The disadvantage of such designs is that the electrical circuit, battery, lamp and switch add additional weight to the archer's arrow which drastically affects the flight of the arrow. In addition, such designs may be susceptible to damage due to the impact the arrow may realize upon the arrow hitting its target. Archers also use arrows for shooting fish, and the electrical circuitry provided in such designs is not practical or operable for use in water and/or other moist and damp environments.

Other designs have utilized chemi-luminescent light sticks to illuminate the nock of an archer's arrow. Such designs require that the archer activate and insert the chemi-luminescent light stick into the nock prior to shooting the arrow. In fact, activation of the chemi-luminescent light stick typically occurs well before shooting the arrow as such activity would typically "spook" the hunted game. This is a disadvantage since the archer must replace the chemi-luminescent light stick to insure that the arrow stays sufficiently illuminated during the time period that an archer may be forced to track an animal it has shot with the arrow. In addition, an illuminated arrow may expose the archer to its game, thereby "spooking" the game prior to the archer shooting the animal.

It would be desirable to provide an illuminated archer's arrow which does not add weight to the arrow. It would also be desirable to provide an illuminated archer's arrow which is not affected by the environment in which it is utilized. Lastly, it would be desirable to provide an illuminated archer's arrow which was activated when shot from an archer's bow.

SUMMARY OF THE INVENTION

The present invention relates to an apparatus for illuminating an archer's arrow. The present invention provides a nock of an archer's arrow adapted to receive a bowstring in a drawn position. A light source is disposed within the nock and is activated when the bowstring is released from the drawn position. The nock is transparent to allow the illumination of the light source to show through the nock.

The nock provides a slot which is adapted to receive the bowstring and a bore which intersects at least a portion of the slot. The light source, preferably a chemi-luminescent light stick, is disposed within the bore and partially intersects at least a portion of the slot. The light stick is engaged and activated by the bowstring when the bowstring is released from the drawn position.

Other advantages and applications of the present invention will become apparent to those skilled in the art when the following description of the best mode contemplated of practicing the invention is read in conjunction with the accompanying drawings.

BRIEF DESCRIPTION OF THE DRAWINGS

The description herein makes reference to the accompanying drawings wherein like reference numerals refer to like parts throughout the several views and wherein.

DETAILED DESCRIPTION OF THE INVENTION

Figure 1:
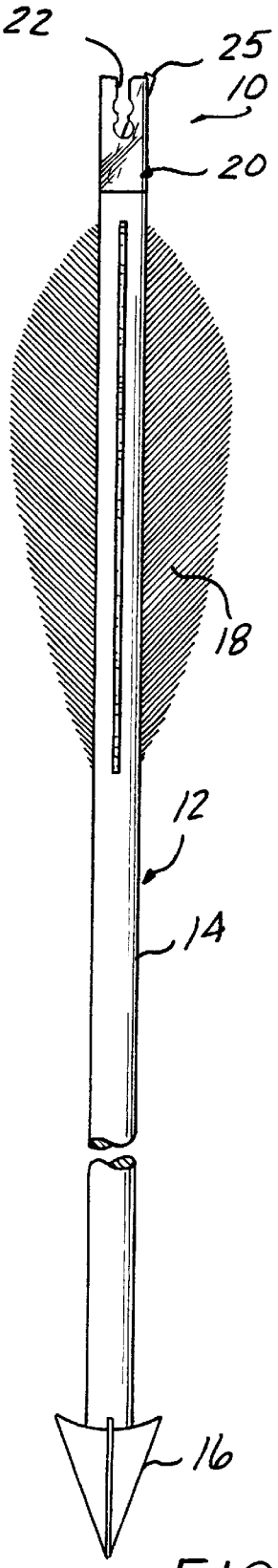
FIG. 1 is a front view of an archer's arrow showing the apparatus of the present invention.
Figure 4:
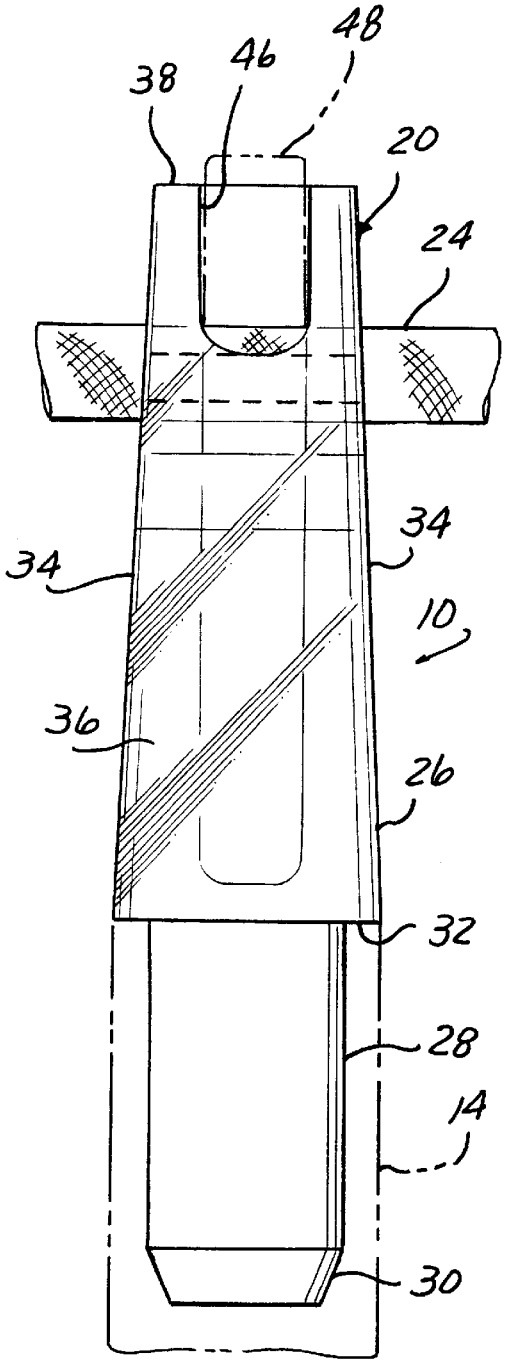
FIG. 4 is a side view showing the bow string and the chemi-luminescent light stick disposed within the nock of the present invention.
Figure 2:
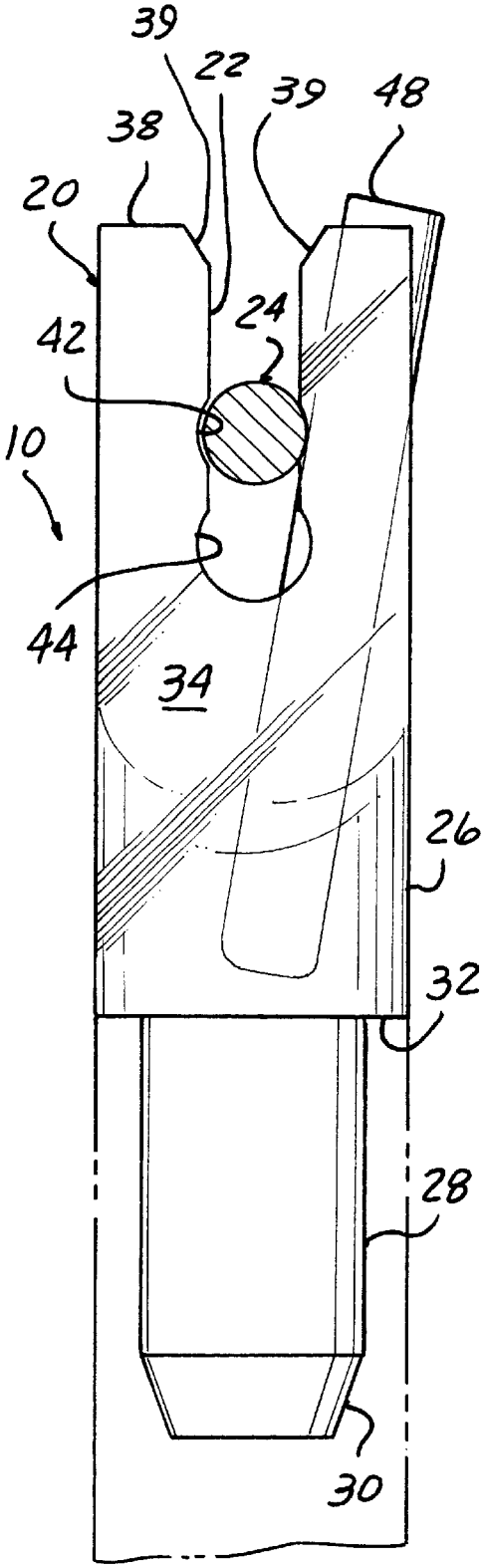
FIG. 2 is a side view of the present invention showing the bowstring disposed within a first widening position of the slot of the nock and a chemi-luminescent light stick disposed in a bore of the nock.
Figure 3:
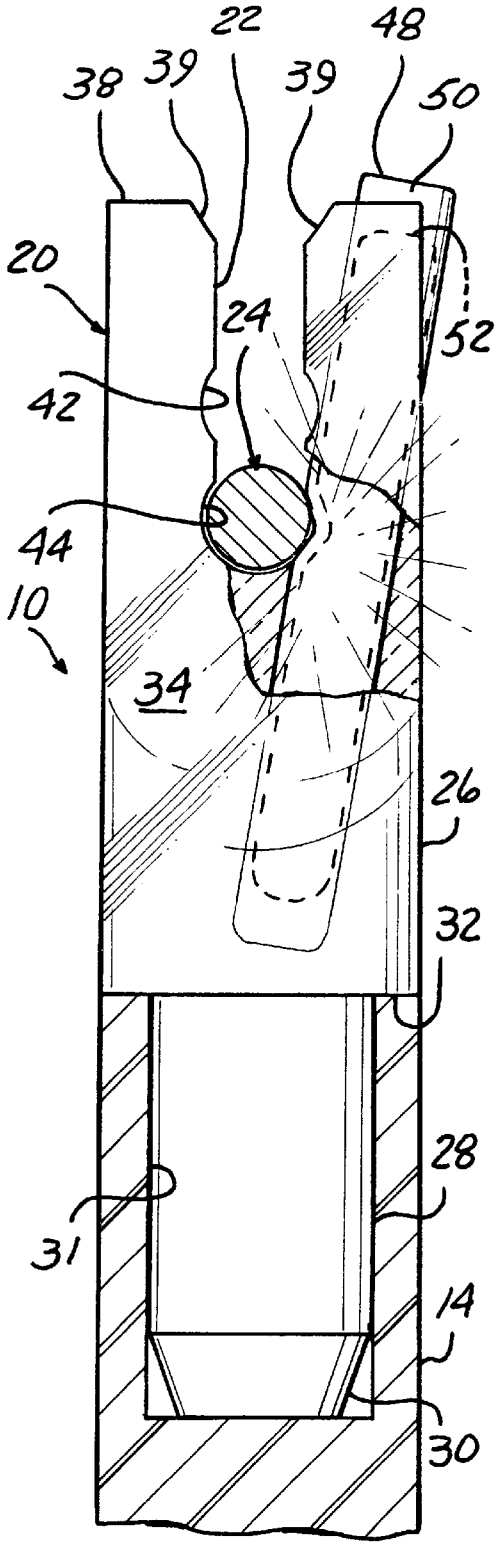
FIG. 3 is a side view of the present invention showing the bowstring disposed within a second widening position of the slot of the nock and activating the chemi-luminescent light stick.
Figure 5:
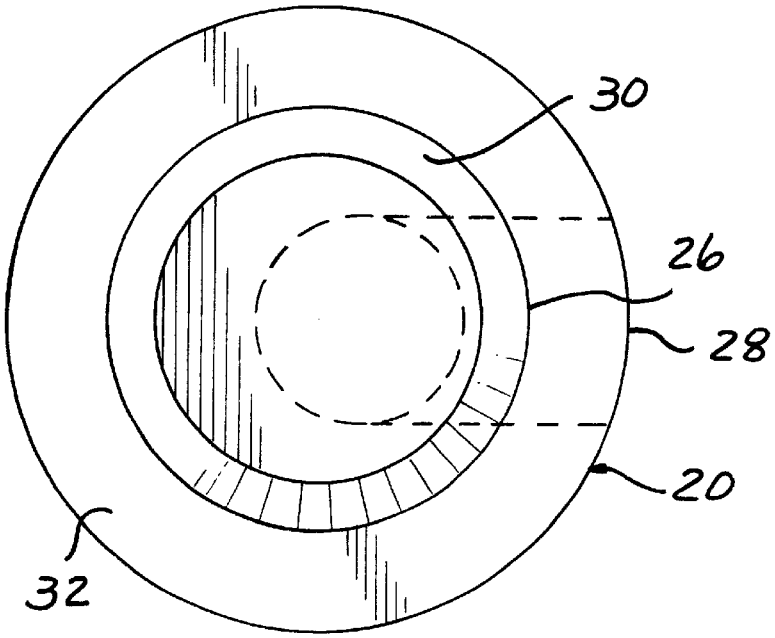
FIG. 5 is a bottom view of the nock of the present invention.
Figure 6:
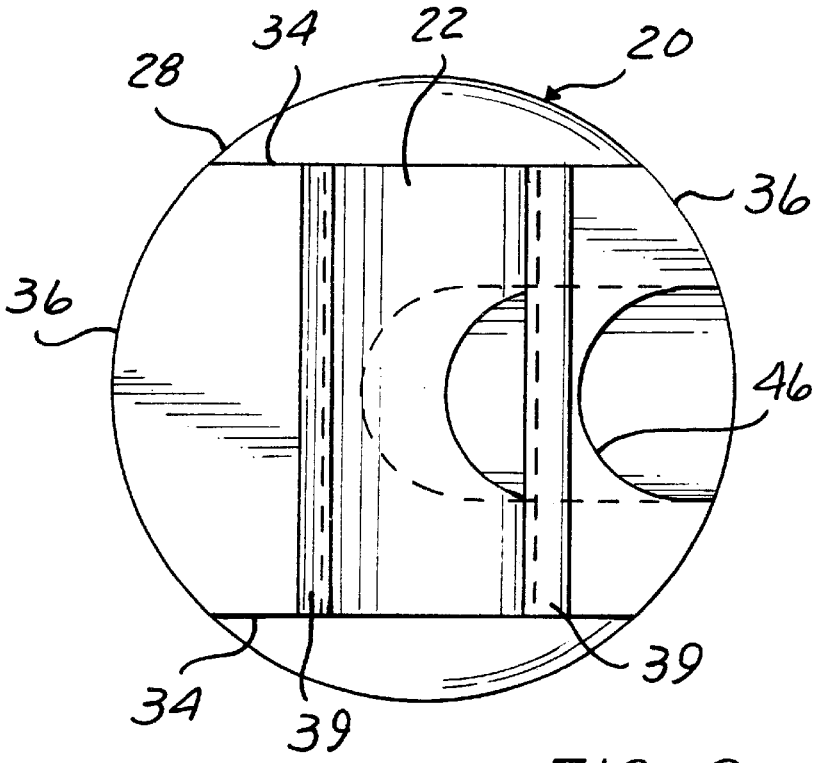
FIG. 6 is a top view of the nock of the present invention.

FIGS. 1–6 illustrate an archer's arrow illuminating apparatus 10 of the present invention. The apparatus 10 provides an archer's arrow 12 having a shaft 14 with a pointed arrowhead 16 at one end of the shaft 14. Several fetchings or cock feathers 18 are connected to the shaft 14 to aid in the flight and control of the arrow 12. A nock 20 is connected to the end of the shaft 14 opposite the end of the shaft 14 having the arrowhead 16 connected thereto. The nock 20 provides a slot 22 for receiving a bowstring 24 of an archer's bow (not shown). The nock 20 also houses a light source 25 for illuminating the nock 20 wherein the nock 20 is fabricated from a transparent material, preferably a translucent plastic, to allow for complete illumination of the nock 20.

To connect the nock 20 to the shaft 14 of the arrow 12, the nock 20 provides an upper portion 26 and a lower portion 28. The lower portion 28 is substantially cylindrical with a chamfered or tapered end 30, as seen in FIGS. 2–5. The end 30 of the lower portion 28 is inserted into and received by a bore 31 in the shaft 14 of the arrow 12. The chamfer or tapered end 30 allows for easier insertion of the lower portion 28 of the nock 20 into the bore 31 of the shaft 14. The upper portion 26 of the nock 20 is integral with and extends from the lower portion 28. The upper portion 26 is somewhat wider than the lower portion 28 thus creating a shoulder 32 on the upper portion 26 where the upper portion 26 and the lower portion 28 meet. The shoulder 32 of the upper portion 26 abuts the end of the shaft 14 of the arrow 12 when the lower portion 28 of the nock 20 is fully inserted into the bore 31 of the shaft 14.

As seen in FIGS. 2–6, the upper portion 26 of the nock 20 has a substantially frusto-conical-like configuration with two substantially flat, opposing sides 34 and two substantially rounded, opposing ends 36. The rounded ends 36 of the upper portion 26 of the nock 20 remain radially spaced from the longitudinal axis of the nock 20 at a constant radial distance. The opposing sides 34 of the upper portion 26 taper inwardly from the substantially circular shoulder 32 to form substantially flat surfaces which angle inwardly toward the longitudinal axis of the nock 20 and toward a free end 38 of the nock 20.

To receive the bowstring 24 of the archer's bow, the upper portion 26 of the nock 20 provides slot 22 which extends between the flat sides 34 of the upper portion 26. The slot 22 extends axially from the free end 38 of the upper portion 26 of the nock 20 to substantially midway into the upper portion 26. The segment of the upper portion 26 defining the slot 22 has chamfered comers 39 at the free end 38 of the nock 20 to help guide the bowstring 24 into the slot 22. The slot 22 also provides first and second widening portions 42, 44, respectively. The first widening portion 42 occurs approximately two-thirds into the axial depth of the slot 22 wherein the portions of the nock 20 which define the slot 22 have opposing arcuate recesses which complement and receive the bowstring 24 in a drawn position. The second widening portion 44 occurs at the bottom of the slot 22 and provides an arcuate recess established in the portion of the nock 20 defining the slot 22. The arcuate recess of the second widening portion 44 is designed to complement and receive the bowstring 24 after the bowstring 24 has been released from its drawn position.

In order to receive and support the light source 25, a bore 46 is provided in the upper portion 26 of the nock 20, as seen in FIGS. 1–4 and 6. The bore 46 extends from the free end 38 of the nock 20 through one of the rounded ends 36 of the upper portion 26 of the nock 20 and continues at an inward angle toward the center of the upper portion 26 so that the bore 46 intersects at least a portion of the second widening portion 44 of the slot 22. The bottom of the bore 46 is closed and contained within the upper portion 26 of the nock 20.

To provide the light source 25 with the attributes of the present invention, the preferred embodiment provides a chemi-luminescent light stick 48 as the light source 25. The light stick 48 is commercially available and is marketed under the trademark CYALUME® of the American Cyanamid Company of Waye, N.J., 07470. The light stick 48 provides a sealed plastic capsule 50 having a smaller sealed vial or compartment 52 within the sealed capsule 50. The small vial or compartment 52 contains a chemical which is allowed to mix with another chemical in the capsule 50 when the vial 52 is broken. The two chemicals provide a chemical reaction which emits light from the capsule 50 but does not produce heat or sparks, thereby making the light stick 48 safe for suitable use in the outdoors.

The light stick 48 has a small cylindrical configuration which fits snugly within the bore 46 of the upper portion 26 of the nock 20 so that the light stick 48 does not become dislodged from the nock 20 when in use. A small portion of the light stick 48 extends outward from the open end of the bore 46 to allow an archer to grasp and remove the light stick 48 when necessary.

In use, an archer places an inactivated light stick 48 in the bore 46 of the upper portion 26 of the nock 20 prior to utilizing the arrow 12. The archer inserts the bowstring 24 into the slot 22 of the upper portion 26 of the nock 20 and draws the bowstring 24 and arrow 12 back to the drawn position. When in the drawn position, the bowstring 24 is received within the first widening portion 42 of the slot 40. When the archer shoots the arrow 12, the bowstring 24 moves from the first widening portion 42 to the second widening portion 44 of the slot 40 thereby engaging the light stick 48. The force of the bowstring 24 breaks the vial 52 within the capsule 50 of the light stick 48 and activates the light stick 48 causing it to illuminate the transparent nock 20. The light stick 48 is thereby activated when the arrow 12 is shot by the archer. This prevents the unnecessary use of the light stick 48 prior to the arrow 12 being shot, and it also prohibits the compromising of the archer's position by the unnecessary glowing of the nock 20 prior to the archer shooting the arrow 12.

While the invention has been described in connection with what is presently considered the most practical and preferred embodiment, it is to be understood that the invention is not to be limited to the disclosed embodiments, but to the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for illuminating an archer's arrow comprising:

a nock adapted to receive a bowstring in a drawn position; and means for activating a light source disposed within said nock when said bowstring is released from said drawn position.

2. The apparatus as stated in claim 1, wherein said nock further comprises:

a slot adapted to receive said bowstring.

3. The apparatus as stated in claim 1, wherein said light source further comprises:

a chemi-luminescent light stick.

4. The apparatus as stated in claim 1, further comprising:

said nock connected to a shaft of an archer's arrow.

5. The apparatus as stated in claim 1, further comprising:

said nock being transparent.

6. An apparatus for illuminating an archer's arrow comprising:

a nock adapted to receive a bowstring in a drawn position;

a light source disposed within said nock and activated when said bowstring is released from said drawn position;

said nock having a slot adapted to receive said bowstring; and said nock having a bore for receiving said light source wherein said bore and said light source intersect at least a portion of said slot.

7. The apparatus as stated in claim 6, wherein said light source further comprises:

a chemi-luminescent light stick.

8. An apparatus for illuminating an archer's arrow comprising:

a nock having a slot adapted to receive a bowstring wherein said slot has a first widening portion adapted to receive said bowstring in a drawn position and a second widening portion adapted to receive said bowstring after said bowstring has been released from said drawn position; and at least a portion of a light source disposed within said second widening portion of said slot in said nock wherein said light source is activated when said bowstring is released from said drawn position.

9. The apparatus as stated in claim 8, wherein said light source further comprises:

a chemi-luminescent light stick.

10. The apparatus as stated in claim 8, further comprising:

said nock being transparent.

11. The apparatus as stated in claim 8, further comprising:

said nock connected to a shaft of an archer's arrow.

12. An apparatus for illuminating an archer's arrow comprising:

a nock having a slot adapted to receive a bowstring wherein said slot has a first widening portion adapted to receive said bowstring in a drawn position and a second widening portion adapted to receive said bowstring after said bowstring is released from said drawn position;

a light source disposed within said nock and activated when said bowstring is released from said drawn position; and said nock having a bore for receiving said light source, and said bore and said light source intersecting at least a portion of said second widening portion of said slot.

13. The apparatus as stated in claim 12, wherein said light source further comprises:

a chemi-luminescent light stick.

14. An apparatus for illuminating an archer's arrow comprising:

a nock having a slot adapted to receive a bowstring wherein said slot has a first widening portion adapted to receive said bowstring in a drawn position and a second widening portion adapted to receive said bowstring after said bowstring has been released form said drawn position;

said nock having a bore intersecting at least a portion of said second widening portion; and a chemi-luminescent light stick disposed within said bore and intersecting at least a portion of said second widening portion, and said light stick engaged and activated by said bowstring when said bowstring is released from said drawn position.

15. The apparatus as stated in claim 14, further comprising:

each of said first and second widening portions formed by arcuate recesses in the portions of said nock defining said slot.

16. The apparatus as stated in claim 14, further comprising:

said nock being transparent.

17. The apparatus as stated in claim 14, further comprising:

said nock connected to a shaft of an archer's arrow.

18. An apparatus for illuminating an archer's arrow comprising:

a nock having a slot adaptable to receive a bowstring; and at least a portion of a light source disposed within said slot wherein said light source is engageable with said bowstring for activating said light source.

* * * * *